US012716584B2

(12) United States Patent
Jones

(10) Patent No.: US 12,716,584 B2
(45) Date of Patent: Aug. 25, 2026

(54) BIOCHAR PRODUCTION PLANT, A COMBUSTION CHAMBER AND A METHOD OF OPERATING THE COMBUSTION CHAMBER

(71) Applicant: Frederick Michael Jones, Guilsfield (GB)

(72) Inventor: Frederick Michael Jones, Guilsfield (GB)

( * ) Notice: Subject to any disclaimer, the term of this patent is extended or adjusted under 35 U.S.C. 154(b) by 504 days.

(21) Appl. No.: 18/554,404

(22) PCT Filed: Apr. 8, 2022

(86) PCT No.: PCT/EP2022/059507
§ 371 (c)(1),
(2) Date: Oct. 6, 2023

(87) PCT Pub. No.: WO2022/214688
PCT Pub. Date: Oct. 13, 2022

(65) Prior Publication Data

US 2024/0240788 A1 Jul. 18, 2024

(30) Foreign Application Priority Data

Apr. 8, 2021 (WO) ..... PCT/EP2021/059217

(51) Int. Cl.
*F23G 5/26* (2006.01)
*F23G 5/027* (2006.01)

(52) U.S. Cl.
CPC ..... *F23G 5/26* (2013.01); *F23G 5/027* (2013.01); *F23G 2207/114* (2013.01); *F23G 2207/20* (2013.01); *F23G 2209/262* (2013.01)

(58) Field of Classification Search
CPC ..... F23G 5/26; F23G 5/027; F23G 2207/114; F23G 2207/20; F23G 2209/262;
(Continued)

(56) References Cited

U.S. PATENT DOCUMENTS 8,691,115 B2 * 4/2014 Schubert ..... C10J 3/723 252/373
9,527,780 B2 * 12/2016 Wilson ..... C05D 9/00
(Continued)

FOREIGN PATENT DOCUMENTS

EP 3800397 A1 4/2021
SE 128398 C1 6/1950

OTHER PUBLICATIONS

International Search Report and Written Opinion issued in counterpart International Application No. PCT/EP2022/059507 on Aug. 5, 2022.

*Primary Examiner* — David J Laux
(74) *Attorney, Agent, or Firm* — Brian J. Colandreo; Jeffrey T. Placker; Holland & Knight LLP

(57) ABSTRACT

The invention relates to a biochar production plant, a combustion chamber, and a method of operating same. The plant comprises a fuel hopper, a fuel delivery system, a combustion stage, and a post combustion stage. The post combustion stage includes a generator; a biochar removal stage and a flue gas scrubber. The combustion stage comprises a combustion chamber having an active fluid biochar bed comprising a pair of oscillating plates, one on top of the other; an air injection ring positioned above and spaced apart from the pair of oscillating plates; a biochar shelf, below and surrounding the active fluid biochar bed, positioned to receive biochar falling from the pair of oscillating plates, and means to transfer the biochar from the biochar shelf to a biochar outlet. There is provided at least one sensor operable to measure the depth of the active fluid biochar bed on the oscillating plates and a controller responsive to the sensor. The controller is operable to control the depth of the active fluid biochar bed and the temperature of combustion by controlling the oscillating plates and the air delivered into the combustion chamber. In this way, the construction is
(Continued)

very simple, cost effective and has accurate combustion control leading to a quality biochar end product.

20 Claims, 9 Drawing Sheets

(58) Field of Classification Search
CPC ..... F23G 2203/805; F23G 2205/121; F23G 7/10; C10B 1/04; C10B 49/10; C10B 53/02
See application file for complete search history.

(56) References Cited

U.S. PATENT DOCUMENTS

| | | | | |
|---|---|---|---|---|
| 9,752,078 | B2 * | 9/2017 | Aupperle | F23L 17/005 |
| 2013/0299332 | A1 * | 11/2013 | Smaidris | C10C 5/00 201/1 |
| 2015/0081086 | A1 * | 3/2015 | Hallowell | F23N 5/003 700/209 |
| 2015/0259603 | A1 | 9/2015 | Hallowell et al. | |

* cited by examiner

BIOCHAR PRODUCTION PLANT, A COMBUSTION CHAMBER AND A METHOD OF OPERATING THE COMBUSTION CHAMBER

RELATED APPLICATIONS

The subject application is a U.S. National Stage application of International Application No. PCT/EP2022/059507, filed on 8 Apr. 2022, which claims the benefit of International Patent Application No. PCT/EP2021/059217, filed on 8 Apr. 2021. The content of each application is incorporated herein by reference in their entirety.

TECHNICAL FIELD

This invention relates to a biochar production plant, a combustion chamber specifically for a biochar production plant, and a method of operating the combustion chamber for the biochar production plant.

BACKGROUND ART

Biochar is a charcoal-like substance made from burning organic material, typically from agricultural and forestry wastes, in a low-oxygen environment. Biochar has not only been found to be an excellent fertilizer, but is also considered to be a highly effective way of sequestering carbon.

More specifically, biochar is understood to have many benefits when used as a fertilizer, including, inter alia, improving the soil structure, improving the soil's microbial properties, as well as improving aeration and water retention properties of the soil. This leads to a fertile soil that facilitates the growth of plants and crops. Biochar is also a relatively inexpensive fertilizer. Artificial fertilizers on the other hand are relatively expensive and over time, it is understood that many artificial fertilizers will have a deleterious effect on soil quality and/or structure. Accordingly, where available, biochar is often seen as a preferable offering to use as a fertilizer.

In addition to being a useful fertilizer, biochar is also seen as a useful tool for carbon sequestration. Indeed, biochar production is deemed to be a carbon-negative process in which it reduces $CO_2$ in the atmosphere. By converting the organic material into biochar, loosely bound or unstable carbon in the decaying material is converted into a highly stable form of carbon that is stored in the biochar. The biochar applied to the soil is then believed to be able to trap the carbon in the soil for hundreds, if not thousands of years. This ultimately reduces the amount of $CO_2$ in the atmosphere.

Furthermore, in addition to the biochar production process and distribution in soil being useful ways of sequestering carbon, and the environmental benefits therefrom, there are several other environmentally beneficial aspects attributable to the production of biochar and use of biochar as a fertilizer. For example, the heat of combustion of the biochar production process may be harnessed and redistributed in a heating system, or may be converted into electricity. This is seen as a useful alternative and environmentally friendly source of heat and/or electricity. Secondly, having the fertile soil will in turn promote plant and crop growth, which in turn will further capture more $CO_2$ from the atmosphere. Thirdly, by providing the biochar as an alternative to artificial, chemical fertilizers, there will be a reduction in green house gas emissions associated with the production and use of those chemical fertilizers.

However, despite the numerous advantageous aspects to the production and use of biochar, it is considered that biochar production and use are still not being exploited to their fullest extent. One potential reason for this is the expense of the known biochar production plants, and in particular the expense of the combustion chambers for the biochar production plants. Another potential reason for this is the complexity of the biochar production plants and combustion chambers for those plants. Careful monitoring and control of the process is required to achieve a premium product and this in turn can lead to complicated and expensive plants. This can dissuade parties from commissioning biochar production plants in favour of less expensive, less complex alternatives.

It is an object of the present invention to provide one or more of a biochar production plant, a combustion chamber for such a plant and/or a method of operating a combustion chamber of a biochar production plant that overcomes at least some of the problems with the known offerings. More specifically, it is an object of the present invention to provide one or more of a biochar production plant, combustion chamber and/or method of operating the combustion chamber of a biochar production plant that is relatively inexpensive and simple to operate. It is a further object of the present invention to provide one or more of a biochar production plant, a combustion chamber for such a plant and/or a method of operating a combustion chamber for a biochar production plant that provides a useful alternative choice for the consumer.

SUMMARY OF INVENTION

According to the invention there is provided abiochar production plant comprising:

- a fuel hopper;
- a fuel delivery system;
- a combustion stage;
- a post combustion stage;
- the post combustion stage including:
  - a biochar removal stage; and a flue gas scrubber;
- the combustion stage comprising a combustion chamber, the combustion chamber having:
  - a fuel inlet for receipt of fuel from the fuel hopper, fed by the fuel delivery system;
  - a fuel outlet for delivering the fuel into the combustion chamber;
  - a biochar outlet for delivery of biochar to the biochar removal stage;
  - an active fluid biochar bed having a pair of oscillating plates superimposed, one plate on top of the other; and an air injection ring positioned above and spaced apart from the pair of oscillating plates;
  - a biochar shelf, surrounding and located at a level below the active fluid biochar bed, positioned to receive biochar falling from the pair of oscillating plates, and means to transfer the biochar from the biochar shelf to the biochar outlet;
  - at least one sensor operable to measure the depth of the active fluid biochar bed; and
  - a controller, responsive to the at least one sensor and operable to control the depth of the active fluid biochar bed.

By having such a plant, it will be possible to accurately control the combustion of the fuel and the resultant properties of the biochar. The amount of oxygen injected through the air injection ring can be carefully controlled to accurately combust substantially all of the syngas emitted from the fuel. Syngas will be emitted from the fuel by the heat inside the combustion chamber, produced from the combustion of other syngas. In this way, a zone effectively free of oxygen will be established in the carbon element of the biochar fuel bed which will initiate the production of biochar. As the biochar passes under the air injection ring, it is moved slowly to the outer edge of the oscillating plates where it will drop to the biochar shelf. This biochar shelf increases the resonation time of the biochar in the combustion chamber by up to 50%. The biochar on the biochar shelf will be at a lower temperature than the biochar on the oscillating plates, and this will allow further leaching of impurities out of the biochar. The biochar on the biochar shelf will be agitated back towards the centre until it drops off the biochar shelf onto the biochar removal stage. This configuration will lead to clean combustion of the syngas which results in a high degree of emissions control, as well as producing a quality biochar product. This is achieved with a plant construction that is simpler, less expensive and with lower maintenance and operation costs than known plants.

In one embodiment of the invention there is provided abiochar production plant in which the controller operable to control the depth of the active fluid biochar bed comprises means to control the speed of oscillation of the oscillating plates. By oscillating the plates, the biochar bed is kept fluid, and biochar is gradually removed from the plates, thereby controlling the depth of the active fluid biochar bed and ensuring complete conversion, before being delivered to a biochar removal stage.

In one embodiment of the invention there is provided abiochar production plant in which the controller operable to control the depth of the active fluid biochar bed comprises means to control the rate of delivery of fuel from the fuel delivery system to the combustion stage. The bulk density and calorific value of the fuel can vary greatly, and the rate of combustion can vary accordingly. In this way, by controlling the rate of delivery of fuel, the plant will produce the biochar in the most efficient manner possible, maintaining clean combustion and target temperatures in the combustion chamber.

In one embodiment of the invention there is provided a biochar production plant in which the post combustion stage further comprises a generator. This is seen as a particularly useful aspect of the present invention. In this way, the biochar production plant can harness the heat and or the exhaust gases from the combustion chamber and use that heat in the production of electricity. Not only will the biochar production plant produce biochar, but it will also be used to generate electricity in a clean and environmentally friendly way.

In one embodiment of the invention there is provided a biochar production plant in which the combustion stage further comprises a pre-conditioner. This is seen as a useful aspect of the present invention that will promote more efficient gasification within the biochar production plant. The pre-conditioner will raise the temperature of the fuel prior to the fuel being delivered into the combustion chamber. The biochar fuel is preferably heated to of the order of ⅔rds of its gasification temperature before it enters the combustion chamber, thereby improving the gasification efficiency of the combustion chamber.

In one embodiment of the invention there is provided a biochar production plant in which the pre-conditioner is operable to heat the fuel to up to 350 degrees Celsius prior to entry of the fuel into the combustion chamber.

In one embodiment of the invention there is provided a biochar production plant in which heat is harnessed from the combustion chamber for use in the pre-conditioner. This is seen as an effective use of resources and reduces the operating cost of the biochar production plant. As an alternative or in addition to the foregoing, the rejected heat from the generator may be harnessed. This will give a 300° C. to 400° C. flow of clean air which can be circulated through the pre-conditioner to raise the temperature of the fuel in the pre-conditioner to the required level by indirect heat transfer. If the combustion chamber is connected to a Blue Box (registered trade mark, ®) Electric generator, it will use the rejected clean air at approximately 300° to 400° C. prior to it passing to the air to water heat exchanger for recovery (if the biochar production plant incorporated a combined heat and power (CHP) system). Alternatively, the air can be rejected directly to atmosphere if heat recovery is not required. If the system is not fitted to a Blue Box® electricity generator, the flue gas can be directed from the boiler to a conditioner prior to the gas entering a wet scrubber.

In one embodiment of the invention there is provided a biochar production plant in which heat is harnessed from the generator for use in the pre-conditioner.

In one embodiment of the invention there is provided a biochar production plant in which the at least one sensor operable to measure the depth of the active fluid biochar bed comprises a pair of pressure sensors, one of which is located above the air injection ring and the other of which is located below the air injection ring. This is seen as a particularly simple configuration and advantageous aspect of the present invention. In this way, the depth of the fluid biochar bed can be determined reliably with relative ease. The negative pressure above the air injection ring can be compared with the negative pressure below the air injection ring. If the negative pressure below the air injection ring decreases (i.e., the pressure differential increases in relation with the negative pressure above the air injection ring), this will be indicative that the level of the biochar bed is rising. This is a very simple, robust, and effective way of measuring the depth of active fluid biochar bed that leads to improved control of the production process.

In one embodiment of the invention there is provided a biochar production plant in which the pair of oscillating plates are star shaped. By having the pair of oscillating plates star-shaped, with a plurality of fingers splayed outwardly from the centre, this will assist in agitating the biochar bed and keeping the biochar bed active. In addition, the star shaped design creates a radial movement of ash due to the interaction of the two plates (also referred to as grates) rotating to different limits. In this way, the biochar is moved outwardly towards the edges of the plates towards the primary drop zone in a controlled manner onto the biochar shelf (also referred to as a second grate) where it is agitated with eight or more paddles connected to the outer points of the larger lower oscillating plate towards a center drop zone.

In one embodiment of the invention there is provided abiochar production plant in which the circumferential edge of each of the oscillating plates has a wave configuration. Again, by having the wave configuration, this will keep the biochar agitated and fluid, allowing the biochar to be moved to the periphery of the plates by the relative movement between the two plates. The wave configuration will also prevent hot spots and stress points.

In one embodiment of the invention there is provided a biochar production plant in which the diameter of the upper oscillating plate is smaller than the diameter of the lower oscillating plate and in which the peaks of the upper oscillating plate coincide with the troughs of the lower oscillating plate.

In one embodiment of the invention there is provided a biochar production plant in which the fuel outlet comprises a frusto-conical shaped fuel nozzle located centrally in the combustion chamber relative the sides of the combustion chamber. This is seen as a useful configuration to promote even distribution of the fuel in the combustion chamber. The fuel will, as it exits the nozzle, slide down the sides of the nozzle towards the oscillating plates. This will also prevent collection of biochar fuel at the base of the nozzle and directs the biochar fuel away from the nozzle.

In one embodiment of the invention there is provided a biochar production plant in which the frusto-conical shaped fuel nozzle further comprises a top plate having the fuel outlet located substantially centrally in the top plate, surrounded by an annular staging area platform for fuel entering the combustion chamber. This is seen as a particularly preferred embodiment of the present invention. By having the annual staging area platform, as the fuel enters the combustion chamber, the fuel will "mushroom" out of the fuel outlet, effectively prolonging the time that the fuel is located adjacent the nozzle before the fuel falls down along the sides of the fuel nozzle. By prolonging the fuel in this location, the fuel will be subjected to the high temperature in this area for longer, causing the syngas to separate from the fuel where it can be burnt with other syngas in the combustion chamber. This aides in the degasification of the biochar and the more efficient burning of gasses in the combustion chamber.

In one embodiment of the invention there is provided a biochar production plant in which the diameter of the fuel outlet is of the order of between 0.25 times and 0.5 times the diameter of the top plate.

In one embodiment of the invention there is provided a biochar production plant in which the means to transfer the biochar from the biochar shelf to the biochar outlet comprises at least one scraper paddle configured to sweep the biochar from the biochar shelf.

In one embodiment of the invention there is provided a biochar production plant in which there are provided a plurality of scraper paddles, each of the plurality of scraper paddles being connected to and downwardly depending from the lower of the pair of oscillating plates. This is seen as a simple configuration to ensure that the biochar is removed off the biochar shelf once it has spent sufficient time on the biochar shelf in a simple and inexpensive manner.

In one embodiment of the invention there is provided a biochar production plant in which the scraper paddles are positioned circumferentially spaced apart from each other, and in which there is provided a paddle located at each of the outermost points of the lower oscillating plate.

In one embodiment of the invention there is provided a biochar production plant in which the air injecting ring surrounds the fuel nozzle, and comprises a plurality of air nozzles through which air is delivered towards the centre of the combustion chamber. This part of the combustion chamber is sometimes referred to as the gasification chamber, in which gas is released from the biochar fuel and combusted.

In one embodiment of the invention there is provided abiochar production plant in which the plurality of air nozzles are inclined, downwardly depending towards the active fluid biochar bed.

In one embodiment of the invention there is provided a biochar production plant in which the plurality of air nozzles are circumferentially spaced about the air injection ring. In this way, the air from the air nozzles will be distributed more evenly in the gasification chamber, promoting more even distribution of air in the chamber and a more even combustion of the syngas. This will facilitate gasification control including temperature control.

In one embodiment of the invention there is provided a biochar production plant in which the plurality of air nozzles are spaced apart by a distance between 0.03 m and 0.1 m. Preferably, the plurality of air nozzles are spaced apart by a distance of 0.05 m (50 mm). A 0.05 m separation between the nozzles is believed to be suitable for many different fuel types.

In one embodiment of the invention there is provided a biochar production plant in which each of the air nozzles has nozzle outlet diameter of between 0.003 m and 0.008 m.

In one embodiment of the invention there is provided abiochar production plant in which the biochar removal stage comprises a water-filled wet biochar removal stage beneath the active fluid biochar bed and the biochar shelf. The water-filled wet biochar removal stage provides a water quench, to cool and humidify the biochar, to eliminate dust and fire risk after removal from the biochar production plant. The water-filled removal stage will provide an air seal between the plant exterior and the combustion chamber. The water level is approximately 0.2 m (200 mm) below the level of the biochar shelf and only recovers heat from the biochar as the biochar enters below the biochar shelf. The outer shell of the water-filled wet biochar removal stage tank is sufficiently large to provide cooling to the water. Furthermore, fresh water is added to replace the water carried away by the biochar as the biochar is removed and this provides additional cooling. In addition to the foregoing, the water utilized in the wet flue scrubber may be cooled prior to being returned to the wet biochar removal system.

In one embodiment of the invention there is provided a biochar production plant in which the water from the wet biochar removal stage is delivered to the flue scrubber for use in neutralizing flue gasses and removing heavy metals in the flue gas. This is seen as a useful function for the water from the wet biochar removal stage as the water will be alkaline in nature and suitable for neutralizing flue gas acids, principally $SO_2$ and HCl.

In one embodiment of the invention there is provided a biochar production plant in which the flue gas scrubber comprises a condenser and a waste water filter. The use of a condenser will ensure a cleaner plume from the flue that will be practically imperceptible. A clean hot airstream is recovered from the flue gas prior to entry to the flue gas scrubber, before being reintroduced to the flue above the Continuous Emissions Monitoring System (CEMS) emissions test ports. In this way, the pluming effect commonly seen emitting from flue exhausts is obviated.

In one embodiment of the invention there is provided abiochar production plant in which the generator comprises an Organic Rankine Cycle (ORC) generator. An ORC generator is seen as a particularly suitable choice as it uses an expander turbine coupled to a high-speed alternator to get electricity from the heat generated by the combustion chamber. In addition to or instead of the foregoing, there may be provided an air-to-air high temperature turbine electrical generator, e.g., a hot air turbine generator. This is particularly suitable where heat recovery is not required.

In one embodiment of the invention there is provided a biochar production plant in which the bottom plate of the pair of oscillating plates oscillates between 0.40 m and 0.60 m, and the top plate of the pair of oscillating plates oscillates between 0.2 m and 0.4 m respectively. The spacings between the individual fingers of the plates are approximately 0.2 m (200 mm), measured center to center of the tips of the fingers.

In this way, the upper plate has the required amount of movement to travel the width between the fingers of the bottom plate. The circumferential distance between the fingers of the bottom plate is the same as the distance between the fingers of the top plates at the same radial distance from a common centre so that the difference of rotation causes the top finger to move across the entire width of the space between two adjacent bottom fingers. If only one plate oscillated, there would be no interaction or agitation and the biochar bed would cease to become active. Large clinker deposits would form and block the system. By rotating the plates in the manner described, the plates will operate in a simple, reliable, and robust manner while providing sufficient agitation to the fluid bed.

The distance of movement is designed that the top plate finger moves across from one of the lower fingers to the adjacent finger so sweeping the entire width of the lower trough. If the top plate was fixed, the biochar ash would bridge and form clinker. The interaction of the two plates is essential for the maintenance of a fluid biochar bed. The plates do not necessarily counter rotate, rather the bottom plate moves through the full arc and the top plates movement (which is driven by frictional contact to the bottom plate) is limited to the dimension of the width of the lower plate.

In one embodiment of the invention there is provided abiochar production plant in which the distance between the air injection ring and the top plate of the pair of oscillating plates is between 0.065 m and 0.12 m. A standard multipurpose setting is 80 mm. The distance will be set to suit the fuel type to be processed in the biochar plant. An energy plant that will process smaller material, typically material having a diameter of 15 mm and below, can have a smaller gap than a biochar plant that is typically used to process larger fuel sizes. The distance is measured from the top of the top oscillating plate to the bottom of the air ring and can be adjusted by insertion or removal of flange packing shims. There is no strict formula regarding the distance between the air injection ring and the plates, and distances can be established using trial and error. Importantly, the system has been designed to allow this distance to be adjusted should a specific fuel require different settings.

In one embodiment of the invention there is provided a combustion chamber for a biochar production plant comprising:

- a fuel inlet for receipt of fuel;
- a fuel outlet for delivering the fuel into the combustion chamber;
- a biochar outlet;
- an active fluid biochar bed having a pair of oscillating plates superimposed, one plate on top of the other; and an air injection ring positioned above and spaced apart from the pair of oscillating plates;
- a biochar shelf, located at a level below the active fluid biochar bed, positioned to receive biochar falling from the pair of oscillating plates, and means to transfer the biochar from the biochar shelf to the biochar outlet;
- at least one sensor operable to measure the depth of the active fluid biochar bed; and
- a controller, responsive to the at least one sensor and operable to control the depth of the active fluid biochar bed.

By having such a combustion chamber, it will be possible to accurately control combustion. This in turn will lead to clean combustion and a high degree of emissions control, as well as reduced downtime for maintenance. This is achieved with a construction that is simpler, less expensive and with lower maintenance and operation costs. Advantageously, the present invention is able to process biochar with a high ash content, of the order of 30% ash content, while maintaining clean combustion and avoiding clinker formation. Advantageously, his allows oversized compost to be processed in the combustion chamber.

In one embodiment of the invention there is provided a combustion chamber for a biochar production plant in which the controller operable to control the depth of the active fluid biochar bed comprises means to control the speed of oscillation of the oscillating plates.

In one embodiment of the invention there is provided a combustion chamber for a biochar production plant in which the controller operable to control the depth of the active fluid biochar bed comprises means to control the rate of delivery of fuel from the fuel delivery system to the combustion stage.

In one embodiment of the invention there is provided a combustion chamber for a biochar production plant in which the combustion stage further comprises a pre-conditioner.

In one embodiment of the invention there is provided a combustion chamber for a biochar production plant in which the pre-conditioner is operable to heat the fuel to up to 350 degrees Celsius prior to entry of the fuel into the combustion chamber.

In one embodiment of the invention there is provided a combustion chamber for a biochar production plant in which heat is harnessed from the combustion chamber for use in the pre-conditioner.

In one embodiment of the invention there is provided a combustion chamber for a biochar production plant in which the at least one sensor operable to measure the depth of the active fluid biochar bed comprises a pair of pressure sensors, one of which is located above the air injection ring and the other of which is located below the air injection ring.

In one embodiment of the invention there is provided a combustion chamber for a biochar production plant in which the pair of oscillating plates are star shaped.

In one embodiment of the invention there is provided a combustion chamber for a biochar production plant in which the circumferential edge of each of the oscillating plates has a wave configuration.

In one embodiment of the invention there is provided a combustion chamber for a biochar production plant in which the diameter of the upper oscillating plate is smaller than the diameter of the lower oscillating plate and in which the peaks of the upper oscillating plate coincide with the troughs of the lower oscillating plate.

In one embodiment of the invention there is provided a combustion chamber for a biochar production plant in which the fuel outlet comprises a frusto-conical shaped fuel nozzle located centrally in the combustion chamber relative the sides of the combustion chamber.

In one embodiment of the invention there is provided a combustion chamber for a biochar production plant in which the frusto-conical shaped fuel nozzle further comprises a top plate having the fuel outlet located substantially centrally in the top plate, surrounded by an annular staging area platform for fuel entering the combustion chamber.

In one embodiment of the invention there is provided a combustion chamber for a biochar production plant in which the diameter of the fuel outlet is of the order of between 0.25 times and 0.5 times the diameter of the top plate.

In one embodiment of the invention there is provided a combustion chamber for a biochar production plant in which the means to transfer the biochar from the biochar shelf to the biochar outlet comprises at least one scraper paddle configured to sweep the biochar from the biochar shelf.

In one embodiment of the invention there is provided a combustion chamber for a biochar production plant in which there are provided a plurality of scraper paddles, each of the plurality of scraper paddles being connected to and downwardly depending from the lower plate of the pair of oscillating plates.

In one embodiment of the invention there is provided a combustion chamber for a biochar production plant in which the scraper paddles are positioned circumferentially spaced apart from each other, and in which there is provided a paddle located at each of the outermost points of the lower plate of the pair of oscillating plates.

In one embodiment of the invention there is provided a combustion chamber for a biochar production plant in which the air injecting ring surrounds the fuel nozzle, and comprises a plurality of air nozzles through which air is delivered towards the centre of the combustion chamber.

In one embodiment of the invention there is provided a combustion chamber for a biochar production plant in which the plurality of air nozzles are inclined, downwardly depending towards the active fluid biochar bed.

In one embodiment of the invention there is provided a combustion chamber for a biochar production plant in which the plurality of air nozzles are circumferentially spaced about the air injection ring.

In one embodiment of the invention there is provided a combustion chamber for a biochar production plant in which the plurality of air nozzles are spaced apart by a distance between 0.03 m and 0.1 m.

In one embodiment of the invention there is provided a combustion chamber for a biochar production plant in which each of the air nozzles has nozzle outlet diameter of between 0.003 m and 0.008 m.

In one embodiment of the invention there is provided a combustion chamber for a biochar production plant in which the bottom plate of the pair of oscillating plates oscillates between 0.40 m and 0.60 m, and the top plate of the pair of oscillating plates oscillates between 0.2 m and 0.4 m respectively. This distance may be measured from the tips of the outer edges of the plates.]

In one embodiment of the invention there is provided a combustion chamber for a biochar production plant in which the distance between the air injection ring and the top plate of the pair of oscillating plates is between 0.065 m and 0.12 m.

In one embodiment of the invention there is provided a method of operating a combustion chamber for a biochar production plant comprising the steps of: providing an active fluid biochar bed with a pair of oscillating plates, the oscillating plates superimposed one on top of the other; providing a biochar shelf, surrounding and located at a level below the active fluid biochar bed, positioned to receive biochar falling from the pair of oscillating plates, and providing means to transfer the biochar from the biochar shelf to a biochar outlet; the method further comprising the steps of: oscillating the pair of oscillating plates; monitoring the depth of biochar of the fluid biochar bed on the oscillating plates; and controlling the intake of fuel into the combustion chamber to prevent the depth of the active fluid biochar bed exceeding a set fluid biochar bed depth parameter. Preferably, the set fluid biochar bed depth parameter is of the order of 0.05 m (50 mm) to 0.1 m (100 mm).

By having such a method of operating a combustion chamber, it will be possible to accurately control combustion. This in turn will lead to clean combustion and a high degree of emissions control, as well as reduced downtime for maintenance. This is achieved with a construction that is simpler, less expensive and with lower maintenance and operation costs. Advantageously, the present invention is able to process biochar with a high ash content, of the order of 30% ash content, while maintaining clean combustion and avoiding clinker formation.

In one embodiment of the invention there is provided a method of operating a combustion chamber for a biochar production plant comprising the step of controlling the speed of oscillation of the pair of oscillating plates in order to maintain the biochar on the oscillating plates for a first predetermined period of time.

In one embodiment of the invention there is provided a method of operating a combustion chamber for a biochar production plant comprising the step of controlling the speed of the means to transfer the biochar from the biochar shelf to a biochar outlet in order to maintain the biochar on the biochar shelf for a second predetermined period of time.

In one embodiment of the invention there is provided a method of operating a combustion chamber for a biochar production plant in which the method comprises the step of monitoring the temperature of the combustion chamber and injecting air into the combustion chamber in order to keep the temperature at or above a desired temperature parameter.

In one embodiment of the invention there is provided a method of operating a combustion chamber for a biochar production plant in which the air is injected into the combustion chamber horizontally or inclined downwardly towards the fluid biochar bed.

In one embodiment of the invention there is provided a method of operating a combustion chamber for a biochar production plant comprising the step of accurately controlling the delivery of air into the combustion chamber to provide adequate oxygen for the combustion of syngas while simultaneously preventing excess oxygen being present in the biochar bed.

BRIEF DESCRIPTION OF THE DRAWINGS

The invention will now be more clearly understood from the following description of some embodiments thereof given by way of example only with reference to the accompanying drawings, in which:—

FIG. 4(*b*) is a plan view similar to FIG. 4(*a*) showing an alternative embodiment of moving grate according to the invention;

DETAILED DESCRIPTION OF THE DRAWINGS

Figure 1:
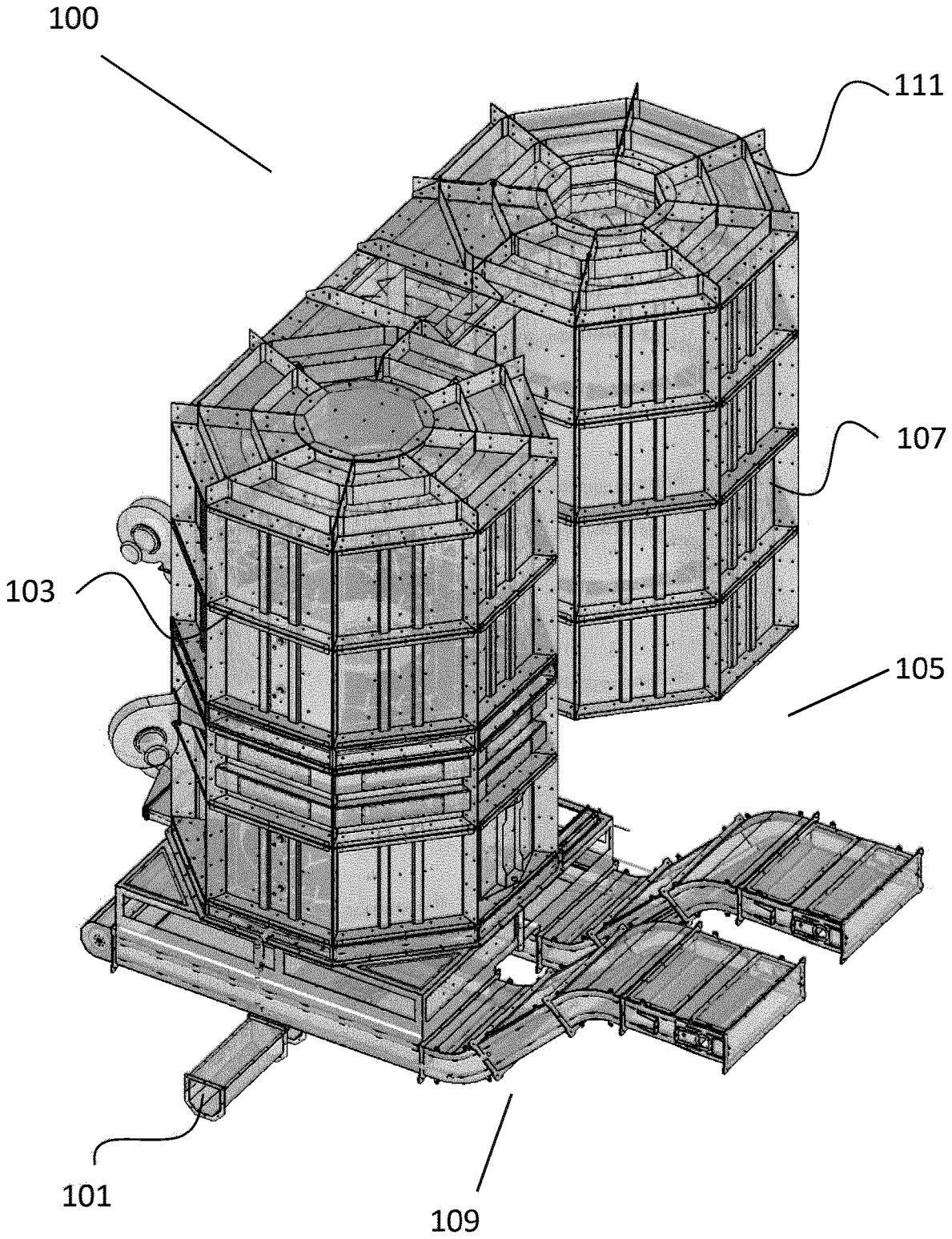
FIG. 1 is a perspective view of part of the biochar production plant according to the invention.
Figure 2:
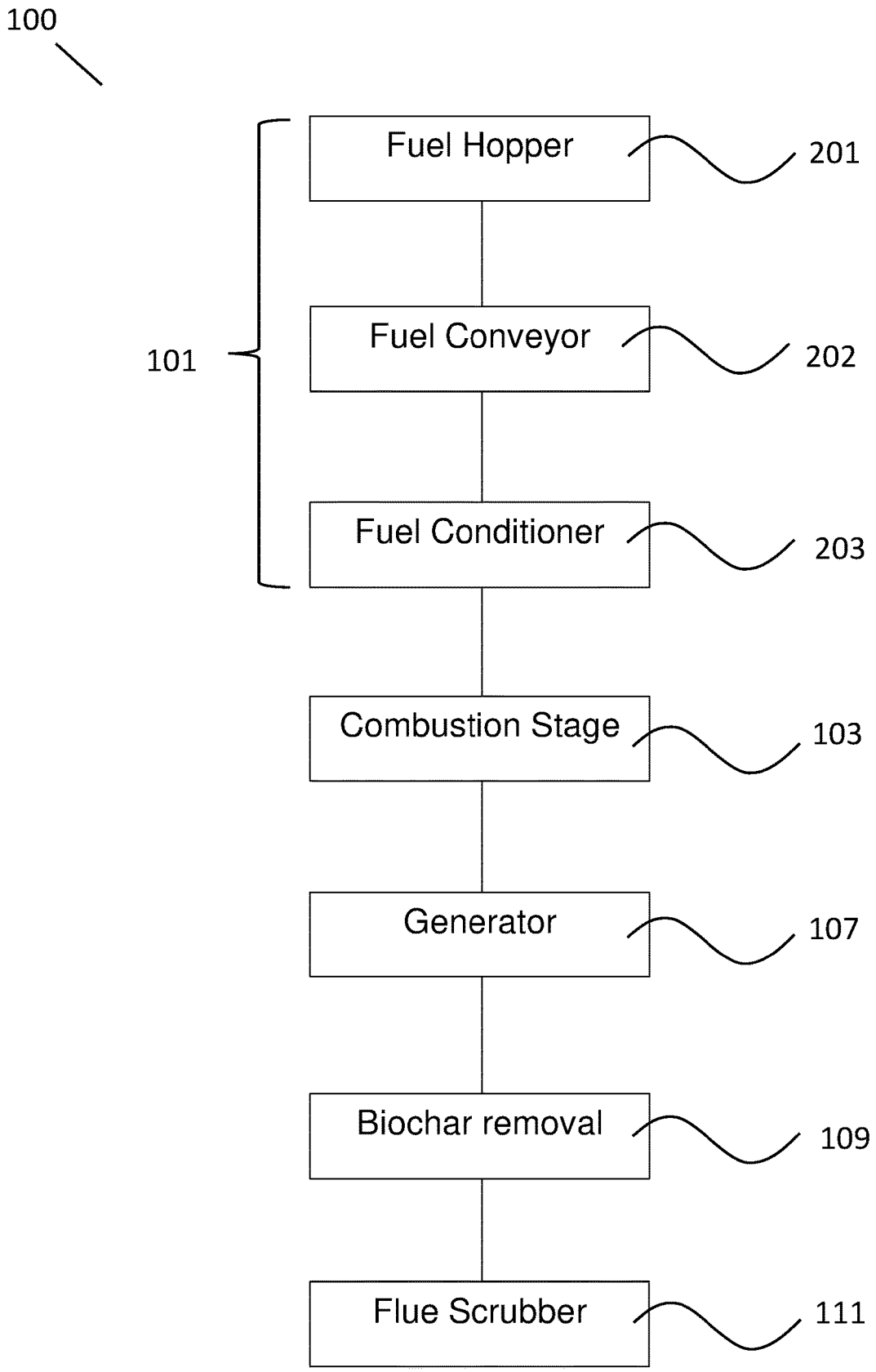
FIG. 2 is a diagrammatic representation of the components of the biochar production plant according to the invention.

Referring to FIGS. 1 and 2, there is shown a biochar production plant, indicated generally by the reference numeral 100, comprising a fuel delivery system 101, a combustion stage 103 and a post combustion stage 105. The post combustion stage comprises a generator 107, a biochar removal stage 109 and a flue gas scrubber 111. Referring specifically to FIG. 2, there is further provided a fuel hopper 201, a fuel conveyor 202 and a fuel conditioner 203 of the fuel delivery system 101. The fuel conditioner 203 is not seen as essential and may be omitted in certain embodiments of the invention.

In use, fuel is delivered from a fuel hopper 201 or other repository along a fuel conveyor 202 of the fuel delivery system 101 to a fuel conditioner 203. The fuel for the biochar may be organic matter from agricultural and/or forestry wastes such as, but not solely limited to, woodchip, wood cuttings, leaves, plants, poultry litter, animal litter, dried animal digested (DAD) material, dried cattle slurry or the like. The fuel in the fuel conditioner is heated to up to of the order of 300° C. to 350° C. In this way, the fuel is brought to a temperature of the order of 75% of its gasification temperature. Gasification typically starts at approximately 400° C. for many of the above-identified fuels. The fuel travels from the fuel conditioner along a conveyor of the fuel delivery system 101 to the combustion stage 103.

The combustion stage comprises a combustion chamber in which the fuel is heated to of the order of 850° C. The combustion chamber and its operation will be described in more detail below with reference to FIGS. 3 to 7 inclusive. The heat and flue gases generated by the burning syngas are transferred from the combustion chamber to the generator 107 and the flue gas scrubber 111, respectively, for conversion into electricity and for cleaning prior to being released into the atmosphere. The biochar from the combustion chamber is delivered through a biochar outlet (not shown) to a biochar removal stage 109 where the biochar is collected for subsequent disposal.

The generator 107 is preferably an Organic Rankine Cycle (ORC) generator. The ORC uses an expander turbine coupled to a high-speed alternator to produce electricity with a high degree of efficiency. The electricity may be used in the facility or exported to the national electricity grid. Alternatively, the generator may be provided by a hot air turbine to generate electricity.

The flue gas scrubber 111 comprises a flue gas cleaning and heat exchanger system such as that produced by Woodtek Engineering Ltd of Welshpool Great Britain. The flue gas scrubber is operable to remove harmful gasses and heavy metals from the flue gas and treat the flue gasses so that they are effectively colourless as they exit the flue. The generator 107 and the flue gas scrubber 111 are shown housed together however this is not essential.

The biochar removal storage stage 109 comprises a wet conveyor that the biochar falls onto (as will be described in more detail below) and is carried by. The biochar is carried from the combustion chamber to a biochar repository.

Figure 3:
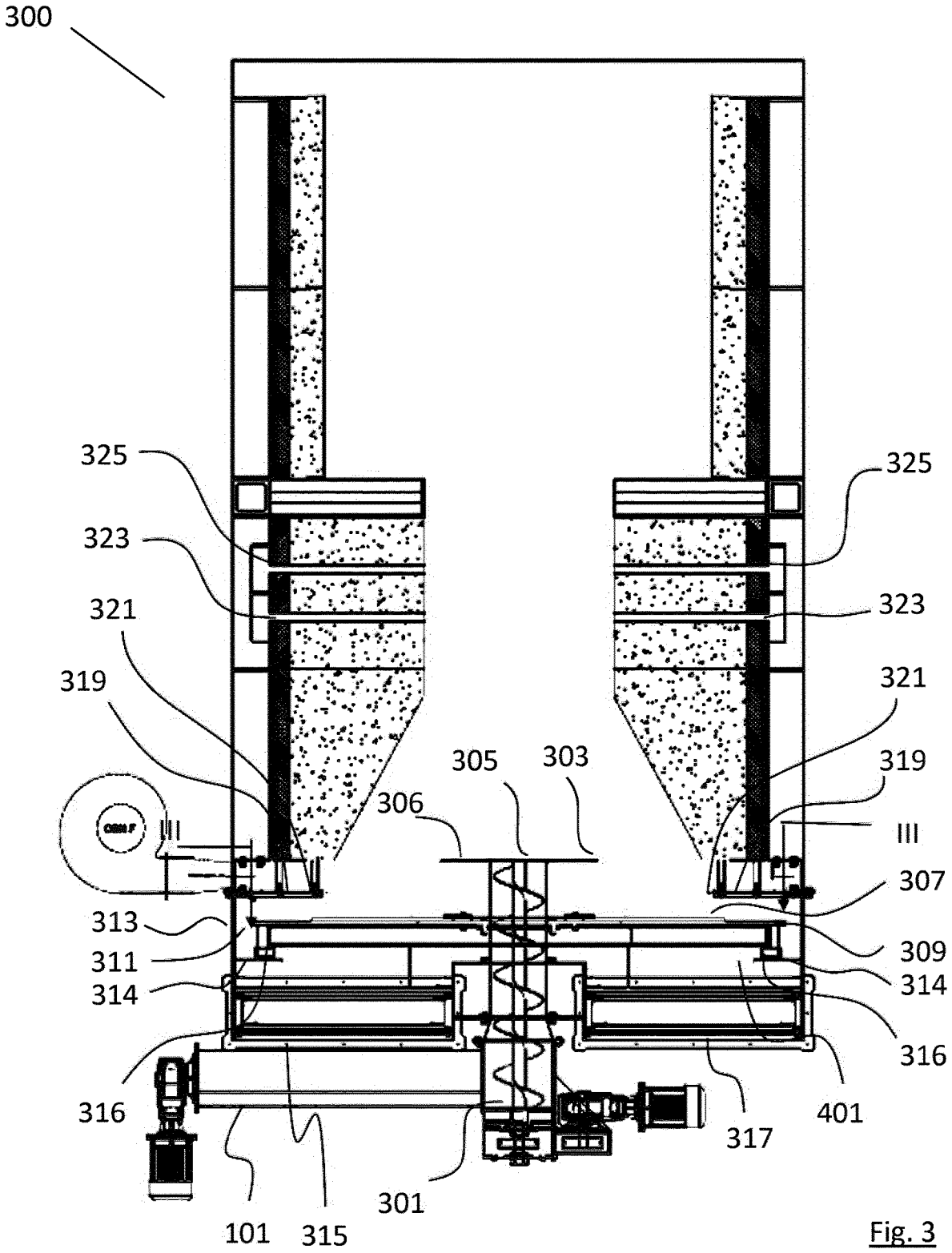
FIG. 3 is a side cross-sectional view of the combustion chamber according to the invention.

Referring now to FIG. 3, there is shown a cross sectional view of the combustion chamber, indicated generally by the reference numeral 300. The combustion chamber is constructed using high grade steel combined with monolithic refractory lining and insulation. Fuel that has been treated in the pre-conditioner is delivered to the combustion chamber 300 along the fuel delivery system 101 to a screw auger 301. Once there, the fuel is progressed up along the screw auger as it rotates through a fuel outlet nozzle 303. The fuel nozzle 303 is substantially frusto-conical in shape with a discharge outlet 305 at is centre.

When the fuel exits the discharge outlet 305, the fuel momentarily sits on a top plate 306 surrounding the fuel discharge outlet before falling along the sides of the fuel nozzle 303 towards an active fluid biochar bed (not shown) on a pair of oscillating plates 307, 309. The pair of oscillating plates 307, 309 are actuated with the effect that the biochar moves towards the periphery of the oscillating plates towards a gap 311 between the lower oscillating plate 309 and the side wall 313 of the combustion chamber. From there, the biochar falls down onto a biochar shelf 314 located below and surrounding the oscillating plates. The biochar on the biochar shelf is agitated by a plurality of paddles 316, and pushed towards the centre of the combustion chamber by those paddles 316. The paddles 316 push the biochar into one of a pair of wet ash conveyors 315, 317 to be carried away from the combustion chamber.

Importantly, there is an air injection ring 319 having a plurality of air nozzles 321 surrounding the outlet nozzle 303, and positioned above and spaced apart from the pair of oscillating plates 307, 309. The air nozzles 321 are shown downwardly depending towards the active fluid biochar bed however this is not necessarily limiting. The temperature of combustion will be regulated in part by the introduction of air. The distance between the air injection ring and the top plate of the pair of oscillating plates is between 0.065 m and 0.12 m (65 mm to 120 mm).

In addition to the air injection ring 319, there is provided a plurality of secondary air inlets 323 circumferentially spaced around the combustion chamber, and a plurality of flue gas recirculation inlets 325 circumferentially spaced around the combustion chamber. In the embodiment shown in FIG. 3, the flue gas recirculation inlets 325 are positioned above the secondary air inlets. The secondary air inlets and the flue gas recirculation inlets are offset to the radial direction so that air entering into the combustion chamber through the secondary air inlets and the flue gas recirculation inlets will form a vortex flow around the fuel discharge outlet 305.

It is envisaged that the standard distance between the air injection ring and the top plate of the pair of oscillating plates will be 80 mm (0.08 m) as this has proven to be the optimum spacing to cover the widest variety of fuels tested. The standard diameter of the air nozzle outlets is preferably 8 mm (0.008 m). This configuration provides an even ring of airstream flow that can be controlled very accurately to the primary combustion zone. In this way, it is possible to control the combustion temperature of different fuels very accurately.

The combustion temperature is controlled by monitoring the furnace temperature immediately above the air injection ring and the differential pressure in the combustion chamber. More specifically, the temperature of the whole primary combustion zone as well as the pressure differential between a point below the air injection ring and a point above the air injection ring can be used to good effect. When the pressure decreases below the air injection ring, the fan speed will increase to increase the combustion rate. Additionally, should the furnace temperature rise above the pre-set limit, then the fuel feed rate will be reduced. By adjusting these two parameters, it is possible to maintain the correct depth of biochar in the fluid biochar bed as well as the set temperature point, normally of the order of 750° C. to 850° C. The volume of air delivered to the air injection ring is controlled by the inverter speed of a primary air fan and this adjusts automatically to match the fuel feed rate. The upper and lower limits can set for each fuel on commissioning.

The ring of secondary air inlets 323 are located between 500 mm and 1.2 m above the primary air injection ring (depending on the size of the model of combustion chamber). The secondary air inlets are configured so that the air passing through the inlets enters the combustion zone at an angle to create a circular vortex of the combustion gases to mix the combustion gases to ensure complete combustion and eliminating hot and cold spots in the combustion zone. The diameter of the inlets vary according to the combustion chamber capacity. The larger the combustion chamber, the larger the inlets.

The base level of volume of secondary combustion air delivered to the combustion chamber is set on commissioning of different fuels in the combustion chamber to achieve a desired $O_2$ content of the combustion gas. It will be understood that different fuels and different fuel conditions will require different levels of added oxygen in order to ensure efficient gasification and combustion. Additionally, there is provided an auto trim control that automatically trims the volume of secondary air delivered into the combustion chamber to maintain the desired set $O_2$ level. In some embodiments, an $O_2$ level (volume) of between 6% and 10% of the total combustion gas volume has been found to be effective.

Immediately above the secondary air inlets 323 there is a ring of flue gas inlets 325 to allow cool clean flue gas to be injected into the combustion chamber to control the intensity and temperature of the combustion and to accurately maintain the optimum gasification and combustion temperature throughout the combustion chamber.

The secondary air injection primarily combusts the syngas. The syngas is the CO and $H_2$ elements separating from the fuel and combusting above the fuel in the middle and upper region of the combustion chamber. The syngas is separated from the fuel as it passes out of the discharge outlet 305 and travels down the side of the fuel outlet nozzle 303 towards the fluid biochar bed. The heat generated in this stage drives the gasification process and the majority of the syngas is driven out of the fuel prior to it entering the fluid biochar bed zone. This allows the temperature of the biochar bed to remain below 750° C., preferably 700° C., which is important to the successful implementation of the plant. In this way, a high grade of biochar can be produced. When the biochar drops onto the biochar shelf 314, it will be at a temperature of the order of between 400° C. and 500° C., and remains at this temperature until it drops into the wet conveyor/wet quench. This delay of the biochar on the biochar shelf at the reduced temperature gives the biochar sufficient time to cure and complete the biochar production process.

The secondary air is controlled at least in part by the exhaust gas lambda sensor which measures the $O_2$ content, relays the information back to the control panel, which then increases or decreases the secondary air fan speed to automatically adjust the amount of air injected. This ensures that correct amount of oxygen is injected for complete combustion to take place. Depending on the fuel being burnt, the range for optimum combustion may be between 6 and 10 percent $O_2$ content in the exhaust gas, If the $O_2$ content is too high, blue smoke is produced and the CO level will be high. If the $O_2$ content is too low, black smoke is produced and again the CO level will be high.

The furnace temperature may be controlled in a number of different ways. First of all, the furnace temperature may be controlled by adjusting the moisture content in the fuel conditioner to achieve the optimum moisture content of the fuel to maintain the desired furnace temperature. For example, drier fuel will increase the furnace temperature whereas more moist fuel will decrease the furnace temperature. The fuel conditioner will add moisture or reduce moisture when required and the fuel conditioner is controlled by the system logic taking the furnace temperature as its data input. For example, it is envisaged that there may be a set minimum moisture content of the fuel set at 15% by weight of the fuel. If the moisture content is below 15%, water will be added to the fuel. In other cases, the fuel may be dried to reduce the moisture content.

A second way in which the furnace temperature may be controlled is by flue gas recirculation. With flue gas recirculation, cool flue gas recovered from after the wet scrubber is introduced adjacent to the secondary air injection points to reduce the secondary combustion temperatures. The rate is adjusted by the furnace temperature and data from a CEMS emissions monitor (not shown). The amount is set and balanced on fuel commissioning. Due to the fact that the flue gas is exhaust gas with low $O_2$ content, this involves recirculation of cool gas that does not combust and so cools the combustion temperature. As the furnace temperature is the prime controller of $O_2$ volume, the level of NOx detected by the CEMS is the secondary indicator and is only used during commissioning to establish the optimum target furnace temperature.

If the combustion temperature falls below the required temperature, the flue gas recirculation volume is reduced to balance the temperature. If the temperature remains under 850° C. after flue gas is reduced to the minimum amount, woodchip is automatically added to the fuel feed to increase the calorific value to maintain the temperature. If the temperature remains under 850° C., a diesel burner (not shown), if provided, may be ignited and the combustor moves to shutdown after a set period.

A plurality of sensors (not shown) are located inside the combustion chamber including a temperature sensor, and a pair of pressure sensors. One pressure sensor is located above the air injection ring and the second pressure sensor is located below the air injection ring adjacent the gap 311 between the lower oscillating plate 309 and the side wall 313 of the combustion chamber. The pressure sensors are operable to measure the negative pressure at those locations. The measurements from the pressure sensors may thereafter be used to determine the depth of the active fluid biochar bed, as will be described in more detail below.

The pressure sensors will be used to detect a change in the pressure (the pressure differential) between the upper pressure sensor and the lower pressure sensor. The higher the active fluid biochar bed is, the higher the pressure recorded by the lower pressure sensor will be. Therefore, if the pressure sensed by the lower pressure sensor should reach a given level, particularly relative to the pressure sensed by the upper pressure sensor, this will be indicative that the active fluid biochar bed has reached a certain height. If the fluid biochar bed is too high, there is a danger that incomplete carburization will occur, and steps will be taken to ensure that the fluid biochar bed height is at the desired level.

A primary air fan speed may be controlled by a variable speed drive to adjust the volume of air injected through the air injection ring. This is controlled in response to a lower furnace temperature probe and the speed of the primary air fan automatically increases or decreases to maintain the target set point which is established on commissioning of various fuels. The operator can take corrective action, automatically through a programmed controller, to reduce the height of the fluid biochar bed by adjusting the lower furnace target temperature set point, by increasing the speed of oscillation of the pair of oscillating plates and/or reducing the rate of fuel feed until the fluid bed level has decreased to a desired level. In addition to the foregoing, there is further provided a temperature sensor in the furnace wall above the combustion ring. This will detect if the biochar level rises above a pre-determined maximum (detected by a drop in temperature in the furnace) and will stop the fuel feed until the temperature rises again as the biochar level drops.

By operating the combustion chamber in this manner, it is possible to combust fuel with a very high ash content, for example, up to 30% ash content. This was not heretofore possible with the existing offerings. By closely managing the temperature of combustion and by managing the depth of the fluid biochar bed, thermal oxidation of the oscillating plate components is virtually eliminated, thereby obviating the need to replace furnace grates as often as would otherwise be the case and increasing the number of combustion hours (and hence efficiency of the plant).

The spacing between the primary air injection ring and the pair of oscillating plates may be varied depending on the particle size of the fuel. For example, a spacing of 100 mm is deemed suitable for green compost oversize fuel. This is to ensure any large non-combustible elements in the fuel, for example, rocks, stones, and metals, can pass between the combustion ring and the oscillating plates and not cause a blockage. For other materials, such as woodchip and the like, 80 mm is deemed to be an advantageous spacing setting. However, if the fuel is of a small size (e.g., 15 mm or less), then the minimum spacing setting of 65 mm would be used.

Figure 4A:
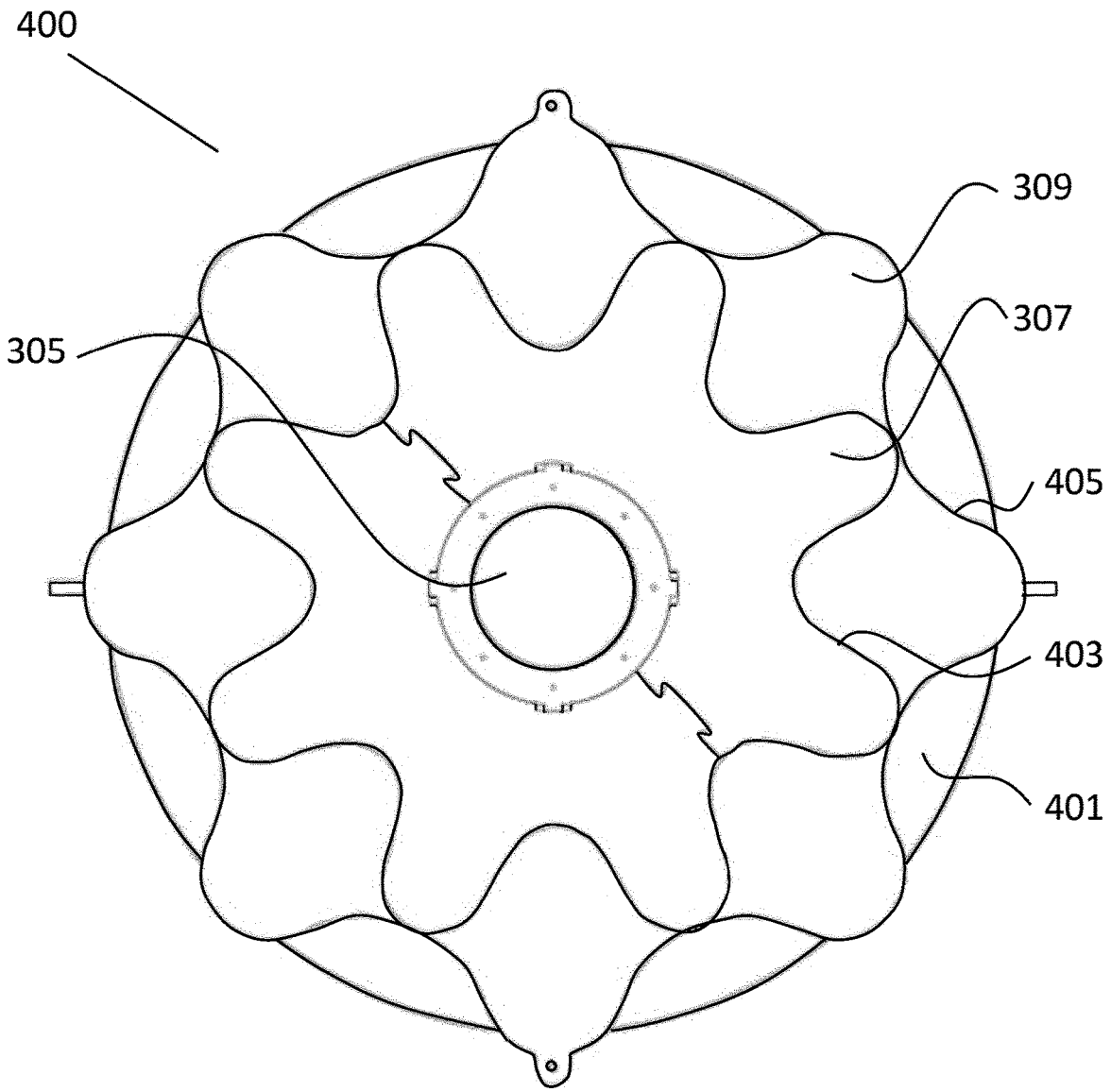
FIG. 4(*a*) is a plan view of the pair of oscillating plates forming the moving grate along the lines III-III of FIG. 3.
Figure 4B:
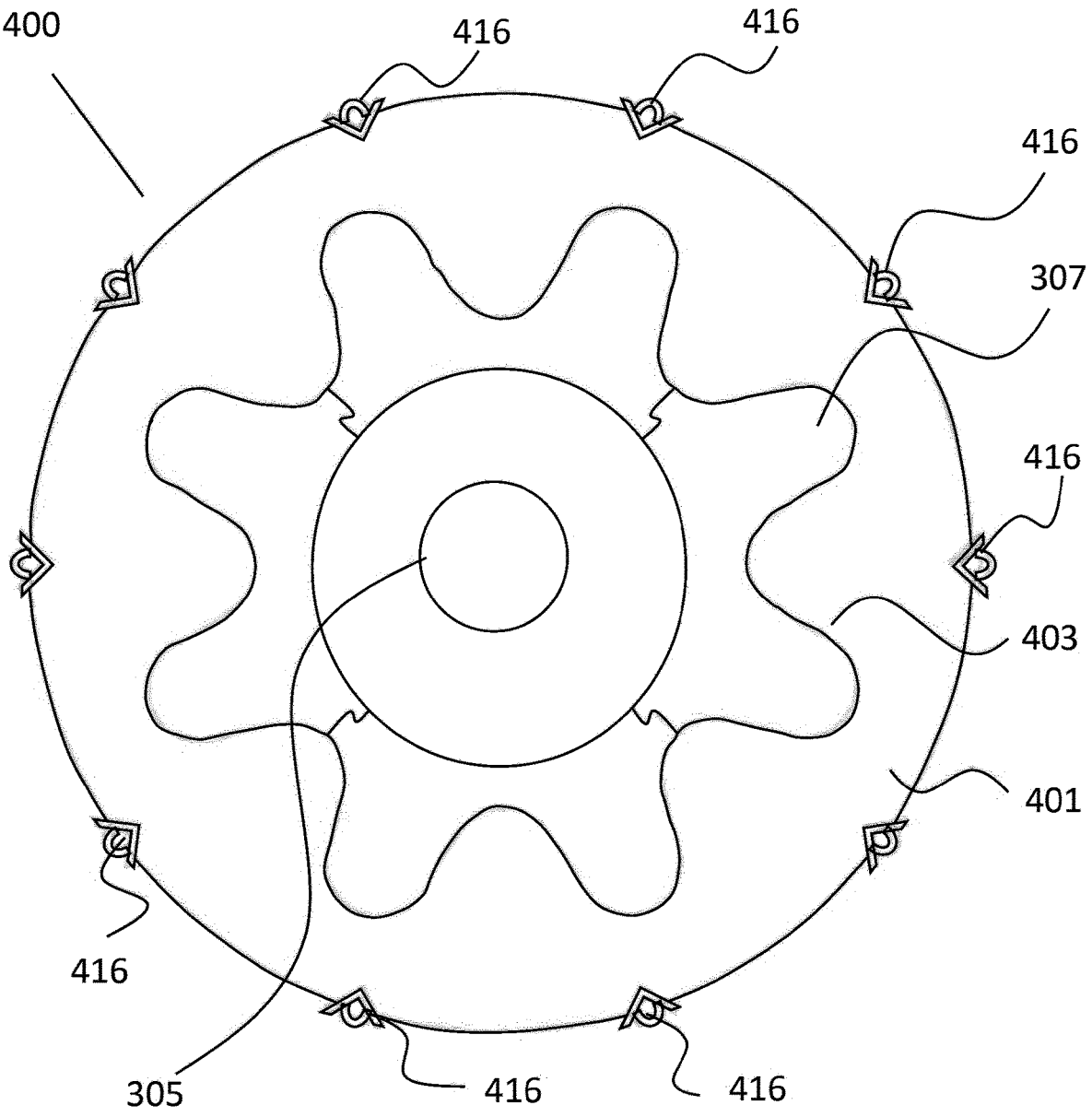

Referring now to FIGS. 4(*a*) and 4(*b*), and initially to FIG. 4(*a*), there is shown is a plan view of the pair of oscillating plates forming the moving grate 400, along the lines III-III of FIG. 3. It can be seen from FIG. 3 that the pair of oscillating plates 307, 309 are substantially star shaped and are mounted over a stationary base plate 401. The circumferential edge 403, 405 of each of the oscillating plates has a wave configuration with peaks and troughs. As can be seen, the upper oscillating plate 307 is smaller in diameter than the diameter of the lower oscillating plate 309 and in which the peaks of the upper oscillating plate coincide with the troughs of the lower oscillating plate.

Referring specifically to FIG. 4(*b*), the lower oscillating plate 309 has been replaced with a circular plate and there is shown the positions of the plurality of paddles 316. The paddles depend downwardly from the outer edges of the lower plate to agitate the biochar on the biochar shelf (not shown) and brush the biochar towards the biochar removal stage.

The circular plate provides more flexibility for the placement of paddles as well as the number of paddles. Alternatively, it is envisaged that a star-shaped lower oscillating plate could be provided with one or more paddles downwardly depending from the outermost end of each of the peaks of the lower oscillating plate. For example, two paddles could be provided on one or more of the peaks, the two paddles being splayed apart from each other. In this way, more paddles will be provided to remove biochar off the biochar shelf. If a circular lower oscillating plate is used, it is envisaged that the upper plate may be dimensioned so that the peaks of the upper plate are approximately 0.05 m (50 mm) from the edge of the round lower plate in order to ensure correct depth of biochar bed on the upper plate.

In use, the design of the plates is such that the main biochar mass sits on the top plate and during the first part of rotation, both plates rotate together thus moving the entire biochar volume at approximately 60% of the set rotation distance. The upper plate reaches a fixed stop which prevents further rotation of the top plate. The lower plate continues to rotate by the remaining approximately 40% of the set rotation angle/distance. As the lower plate continues to rotate, the biochar in contact with the lower plate will be moved under the weight of the biochar on the upper plate. In this way, the biochar is agitated and remains fluid, and will move radially outwardly towards the drop zone at the periphery of the plate.

Figure 5:
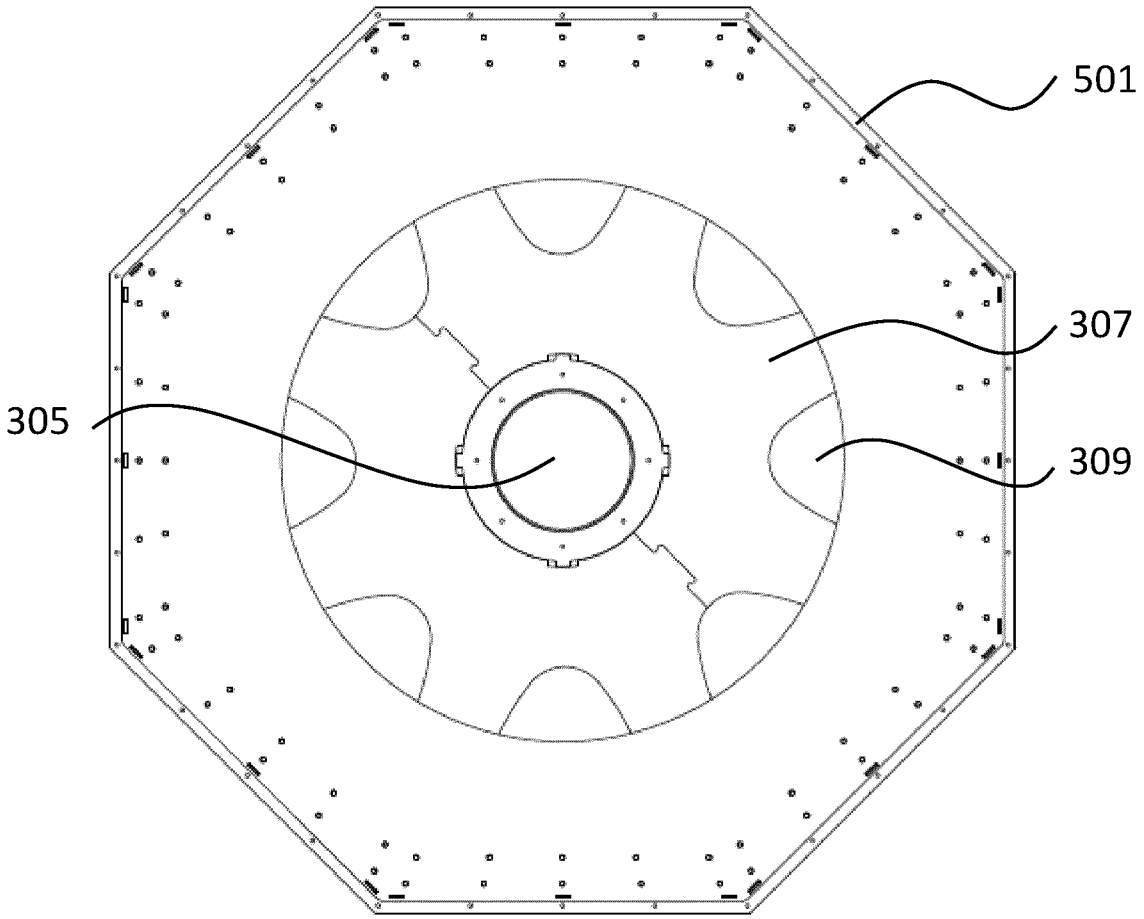
FIG. 5 is a top plan view of the air injection ring.

Referring to FIG. 5, there is shown a top plan view of the air injection ring 309. In use, fuel travels up the screw auger and passes out of the fuel outlet 305 from where it falls between the inner lip 503 of the air diffuser plate 501 and the fuel nozzle onto the upper oscillating plate 307.

Figure 6:
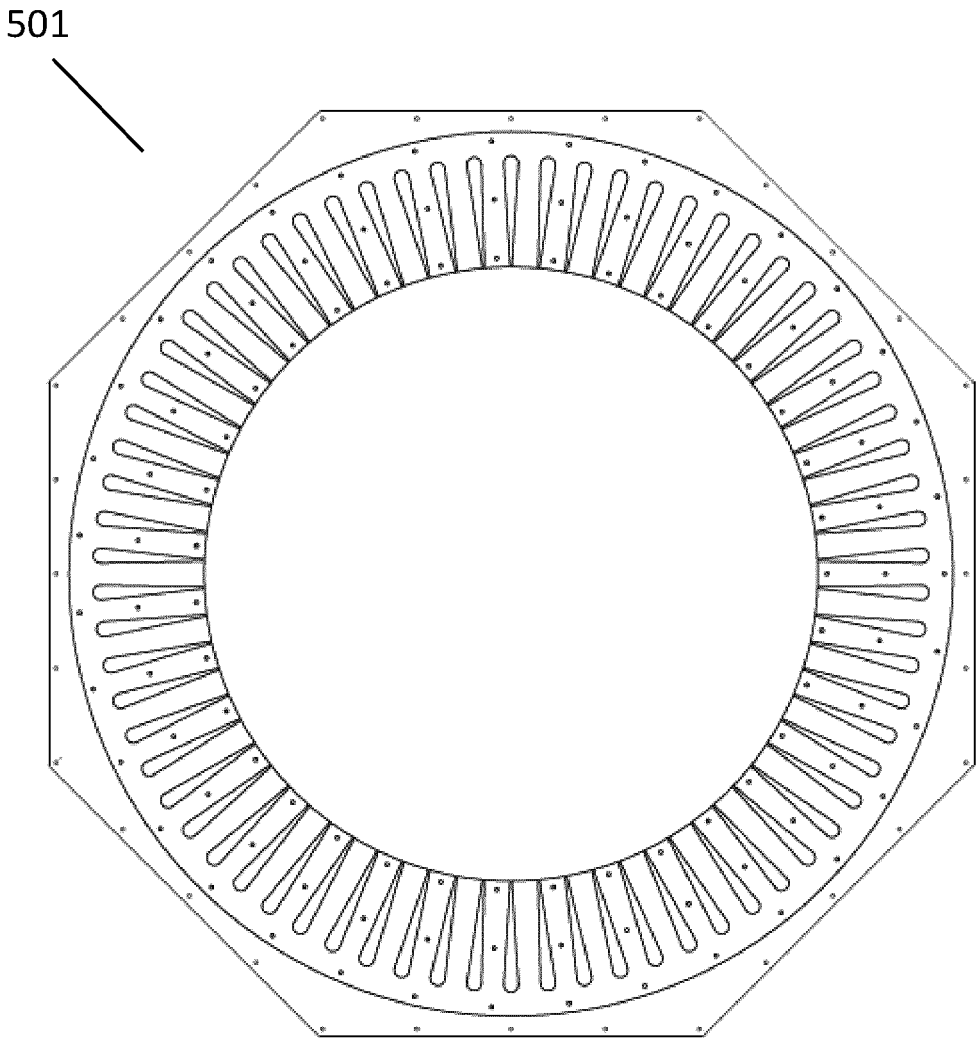
FIG. 6 is a bottom plan view of the air diffuser plate with its cover plate removed.
Figure 7:
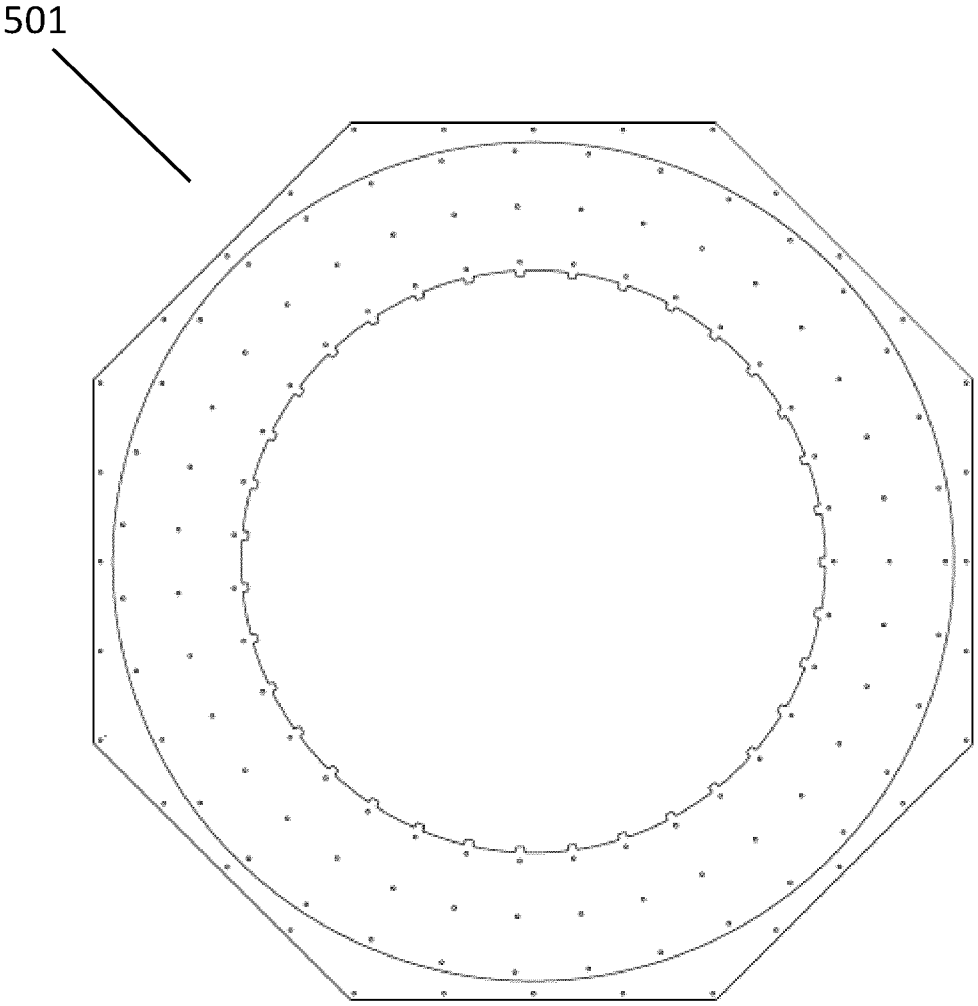
FIG. 7 is a bottom plan view of the air diffuser with its cover plate attached.

Referring to FIGS. 6 and 7, there is shown a bottom plan view of the air diffuser plate 501 with its cover plate removed, and a bottom plan view of the air diffuser plate 501 with the cover plate in position, respectively. In FIG. 6, it can be seen that there are a number of air outlets spaced evenly, circumferentially around the air diffuser plate. There are provided a plurality of air channels/air ducts feeding the air outlets. In use, air enters the air ducts from a chamber (not shown) on the outside of the combustion ring (air injection ring), passes along the air ducts and exits from the air outlets. In FIG. 7, there is shown a bottom plan view of the air diffuser plate with the cover plate in position. In this way, the entire component may be removed and replaced if required due to wear and tear without requiring the remainder of the air injection ring to be removed.

Figure 8:
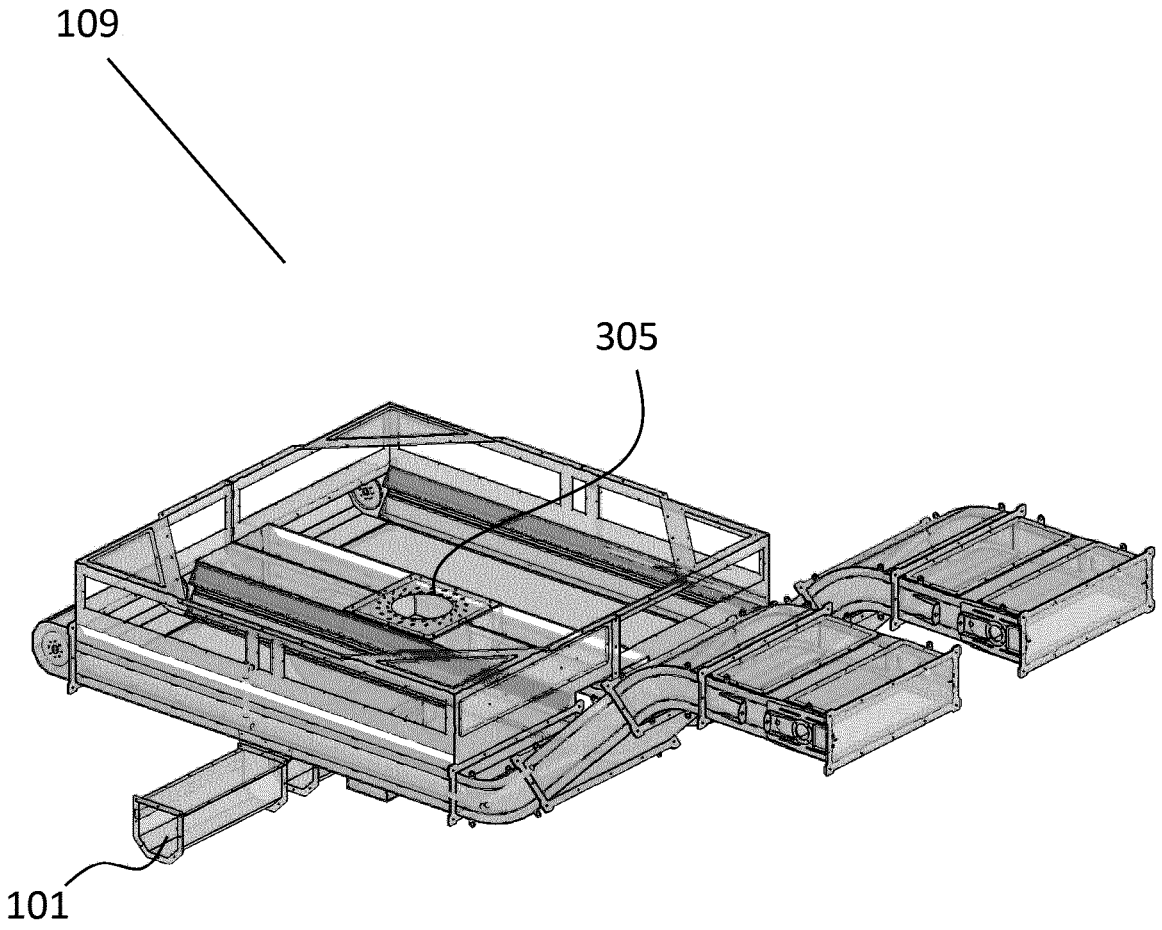
FIG. 8 is a perspective view of the biochar removal stage of the biochar production plant according to the invention.

Finally, referring to FIG. 8, there is shown a perspective view of the biochar removal stage 109 of the biochar production plant according to the invention. The wet biochar removal stage 109 comprises a pair of wet conveyors 801, 803 on which the biochar is transported to a biochar repository.

It will be understood that the present invention also comprises a programmable controller with computer program instructions loaded thereon, that receives measurements from the pressure sensors and the temperature sensor and operates one or more of the screw auger, the oscillating plates, and the air injection ring to keep the temperature in the combustion chamber at a relatively stable, desired temperature. In this way, the combustion is "clean", burning the toxins, harnessing the optimum amount of energy from the syngas. In addition, in certain implementations, there may be provided a gas or like burner (not shown) operable to get the combustion chamber up to temperature on start up.

One example of air injection content (primary, secondary and flue gas recirculation) and burning temperatures, fluid biochar bed depth and oscillation speeds of the plates will now be provided by way of example, merely to give an indication of some operating parameters that are suitable depending on fuel type and consistency. Other parameters would suit other fuels with different moisture and ash content levels and the person skilled in the art would appreciate from the foregoing how the parameters could be adjusted depending on the nature of the fuel used for the biochar production plant.

EXAMPLE 1

A whole tree woodchip with a moisture content of 15% and an ash content of 15% was processed using the following parameters: Fan speeds: Primary air fan operated at between 40% to 65% of maximum fan speed (the precise speed will be controlled in response to the lower furnace temperature sensor); Secondary air 20 to 60% (controlled by Oxygen level); Flue gas recirculation 25% TO 90% (the precise speed will be controlled in response to the upper furnace temperature sensor). The primary combustion zone temperature was 850° ° C. the secondary combustion zone temperature was at 900° C., the fluid biochar bed depth was 0.08 m (80 mm), and the grate oscillation time delay was set at between 15 seconds to 35 seconds. [The primary combustion zone is located in the combustion chamber from a point adjacent to the air injection ring and extends upwardly to the lower secondary air inlets. Above those secondary air inlets to the exhaust gas exit at the top of the combustion chamber is considered to be the secondary combustion zone.]

In this specification the terms "comprise, comprises, comprised and comprising" and the terms "include, includes, included and including" are all deemed interchangeable and should be afforded the widest possible interpretation.

The invention is not solely limited to the embodiment hereinbefore described but may be varied in both construction and detail within the scope of the appended claims.

The invention claimed is:

1. A biochar production plant comprising:
a fuel hopper;
a fuel delivery system;
a combustion stage;
a post combustion stage;
the post combustion stage including:
a biochar removal stage; and a flue gas scrubber;
the combustion stage comprising a combustion chamber, the combustion chamber having:
a fuel inlet for receipt of fuel from the fuel hopper, fed by the fuel delivery system;
a fuel outlet for delivering the fuel into the combustion chamber;
a biochar outlet for delivery of biochar to the biochar removal stage;
an active fluid biochar bed having a pair of oscillating plates superimposed, one plate on top of the other; and an air injection ring positioned above and spaced apart from the pair of oscillating plates;
a biochar shelf, surrounding and located at a level below the active fluid biochar bed, positioned to receive biochar falling from the pair of oscillating plates, and means to transfer the biochar from the biochar shelf to the biochar outlet;
at least one sensor operable to measure the depth of the active fluid biochar bed; and
a controller, responsive to the at least one sensor and operable to control the depth of the active fluid biochar bed.

2. The biochar production plant as claimed in claim 1 in which the controller operable to control the depth of the active fluid biochar bed comprises means to control the speed of oscillation of the oscillating plates.

3. The biochar production plant as claimed in claim 1 in which the controller operable to control the depth of the active fluid biochar bed is configured to control the rate of delivery of fuel from the fuel delivery system to the combustion stage.

4. The biochar production plant as claimed in claim 1 in which the post combustion stage further comprises a generator.

5. The biochar production plant as claimed in claim 1 in which the combustion stage further comprises a pre-conditioner.

6. The biochar production plant as claimed in claim 5 in which the pre-conditioner is operable to heat the fuel to up to 350 degrees Celsius prior to entry of the fuel into the combustion chamber.

7. The biochar production plant as claimed in claim 1 in which the at least one sensor operable to measure the depth of the active fluid biochar bed comprises a pair of pressure sensors, one of which is located above the air injection ring and the other of which is located below the air injection ring.

8. The biochar production plant as claimed in claim 1 in which the pair of oscillating plates are star shaped.

9. The biochar production plant as claimed in claim 1 in which the fuel outlet comprises a frusto-conical shaped fuel nozzle located centrally in the combustion chamber relative the sides of the combustion chamber.

10. The biochar production plant as claimed in claim 9 in which the frusto-conical shaped fuel nozzle further comprises a top plate having the fuel outlet located substantially centrally in the top plate, surrounded by an annular staging area platform for fuel entering the combustion chamber.

11. The biochar production plant as claimed in claim 1 in which the means to transfer the biochar from the biochar shelf to the biochar outlet comprises at least one scraper paddle configured to sweep the biochar from the biochar shelf.

12. The biochar production plant as claimed in claim 1 in which the air injecting ring surrounds the fuel nozzle, and comprises a plurality of air nozzles through which air is delivered towards the centre of the combustion chamber.

13. The biochar production plant as claimed in claim 1 in which the biochar removal stage comprises a water-filled wet biochar removal stage beneath the active fluid biochar bed and the biochar shelf.

14. A combustion chamber for a biochar production plant comprising:
a fuel inlet for receipt of fuel;
a fuel outlet for delivering the fuel into the combustion chamber;
a biochar outlet;
an active fluid biochar bed having a pair of oscillating plates superimposed, one plate on top of the other; and an air injection ring positioned above and spaced apart from the pair of oscillating plates;
a biochar shelf, located at a level below the active fluid biochar bed, positioned to receive biochar falling from the pair of oscillating plates, and means to transfer the biochar from the biochar shelf to the biochar outlet;
at least one sensor operable to measure the depth of the active fluid biochar bed; and
a controller, responsive to the at least one sensor and operable to control the depth of the active fluid biochar bed; and
in which the fuel outlet comprises a frusto-conical shaped fuel nozzle located centrally in the combustion chamber relative the sides of the combustion chamber, and in which the frusto-conical shaped fuel nozzle further comprises a top plate having the fuel outlet located substantially centrally in the top plate, surrounded by an annular staging area platform for fuel entering the combustion chamber.

15. The combustion chamber for a biochar production plant as claimed in claim 14 in which the controller operable to control the depth of the active fluid biochar bed is operable to control the speed of oscillation of the oscillating plates.

16. The combustion chamber for a biochar production plant as claimed in claim 14 in which the controller operable to control the depth of the active fluid biochar bed is operable to control the rate of delivery of fuel from the fuel delivery system to the combustion stage.

17. The combustion chamber for a biochar production plant as claimed in claim 14 in which the at least one sensor operable to measure the depth of the active fluid biochar bed comprises a pair of pressure sensors, one of which is located above the air injection ring and the other of which is located below the air injection ring.

18. A method of operating a combustion chamber for a biochar production plant comprising the steps of: providing an active fluid biochar bed with a pair of oscillating plates, the oscillating plates superimposed one on top of the other;

providing a biochar shelf, surrounding and located at a level below the active fluid biochar bed, positioned to receive biochar falling from the pair of oscillating plates, and providing means to transfer the biochar from the biochar shelf to a biochar outlet; the method further comprising the steps of: oscillating the pair of oscillating plates;

monitoring the depth of biochar of the fluid biochar bed on the oscillating plates; and controlling the intake of fuel into the combustion chamber to prevent the depth of the active fluid biochar bed exceeding a set fluid biochar bed depth parameter.

19. The method of operating a combustion chamber for a biochar production plant as claimed in claim 18 comprising the step of controlling the speed of oscillation of the pair of oscillating plates in order to maintain the biochar on the oscillating plates for a first predetermined period of time.

20. The method of operating a combustion chamber for a biochar production plant as claimed in claim 18 comprising the step of controlling the speed of the means to transfer the biochar from the biochar shelf to a biochar outlet in order to maintain the biochar on the biochar shelf for a second predetermined period of time.

* * * * *